US005167194A

United States Patent [19]

Nakagaki

[11] Patent Number: 5,167,194

[45] Date of Patent: Dec. 1, 1992

[54] EMBROIDERING MACHINE

[75] Inventor: Hideaki Nakagaki, Kariya, Japan

[73] Assignee: Aisin Seiki Kabushiki Kaisha, Kariya, Japan

[21] Appl. No.: 703,728

[22] Filed: May 21, 1991

[30] Foreign Application Priority Data

May 22, 1990 [JP] Japan ..... 2-53367

[51] Int. Cl.[5] ..... D05B 21/00; D05C 5/02

[52] U.S. Cl. ..... 112/103; 112/121.12; 112/308; 112/318

[58] Field of Search ..... 112/103, 63, 121.15, 112/121.12, 90, 121.24, 2, 318, 322, 262.2, 262.3, 102, 308

[56] References Cited

U.S. PATENT DOCUMENTS 4,530,294 7/1985 Pollmeier et al. ..... 112/63
4,998,964 3/1991 Golia ..... 112/103 X
5,003,895 4/1991 Talanker ..... 112/103

FOREIGN PATENT DOCUMENTS 62-206077 9/1987 Japan .

*Primary Examiner*—Peter Nerbun
*Attorney, Agent, or Firm*—Burns, Doane, Swecker & Mathis

[57] ABSTRACT

An embroidering machine comprises a stationary shaft, a sleeve slidably mounted on the stationary shaft, a frame device rotatably mounted on the sleeve and holding a cylindrical portion of a work to be stitched with embroidery, a holder secured to the sleeve, a motor for swinging the frame device and a driving device for moving the holder along the stationary shaft.

7 Claims, 5 Drawing Sheets

EMBROIDERING MACHINE

BACKGROUND OF THE INVENTION

The present invention relates to an embroidering machine, and in particular to an embroidering machine for stitching one or more embroideries on a cylindrical portion of a workpiece such as cap or hat.

A conventional embroidering machine of the type has been disclosed in Japanese Patent Laid-open Print No. 62(1987)-206077 which was published without examination in Sep. 10, 1987. The conventional machine includes a base frame on which a cylindrical portion of a workpiece is held, a first motor for bringing the base frame into a swing or vertical movement and a second motor for moving the base frame in the horizontal direction.

However, the first motor per se is set to be stationary and the swing movement of the base frame is established by cam means disposed between the first motor and the base frame. This adds to the complexity of construction therebetween. In addition, the actual swing of the hat has to be converted into a corresponding rotating quantity of the first motor, thereby increasing the steps in a program to be run by a micro-processor for controlling the motors.

SUMMARY OF THE INVENTION

It is, therefore, a primary abject of the present invention to provide an enbroidering machine without the foregoing drawbacks.

To achieve the objects and in accordance with the purposes of the present invention, an embroidering machine comprises a stationary shaft, a sleeve slidably mounted on the stationary shaft, a frame device rotatably mounted on the sleeve, and holding a cylindrical portion of a workpiece to be stitched with an embroidery, a holder secured to the sleeve, a motor for swinging the frame device, and a driving device for moving the holder along the stationary shaft.

BRIEF DESCRIPTION OF THE DRAWINGS

The above and other objects, features and advantages of the present invention will be become more apparent and more readily appreciated from the following detailed description of preferred examplary embodiments of the present invention, taken in connection with the accompanying drawings, in which.

DETAILED DESCRIPTION OF THE PREFERRED EMBODIMENT

Figure 1:
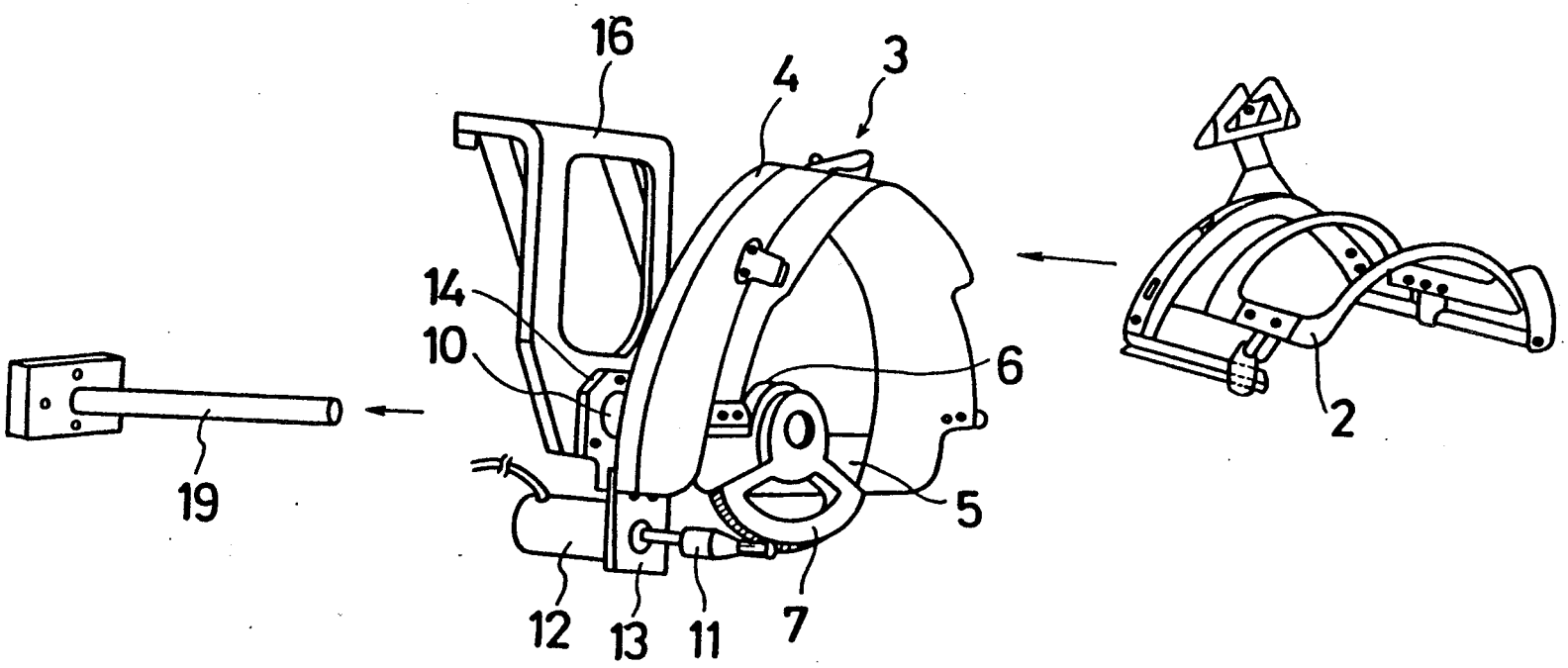
FIG. 1 is a perspective view of an embroidering machine according to the present invention.
Figure 2:
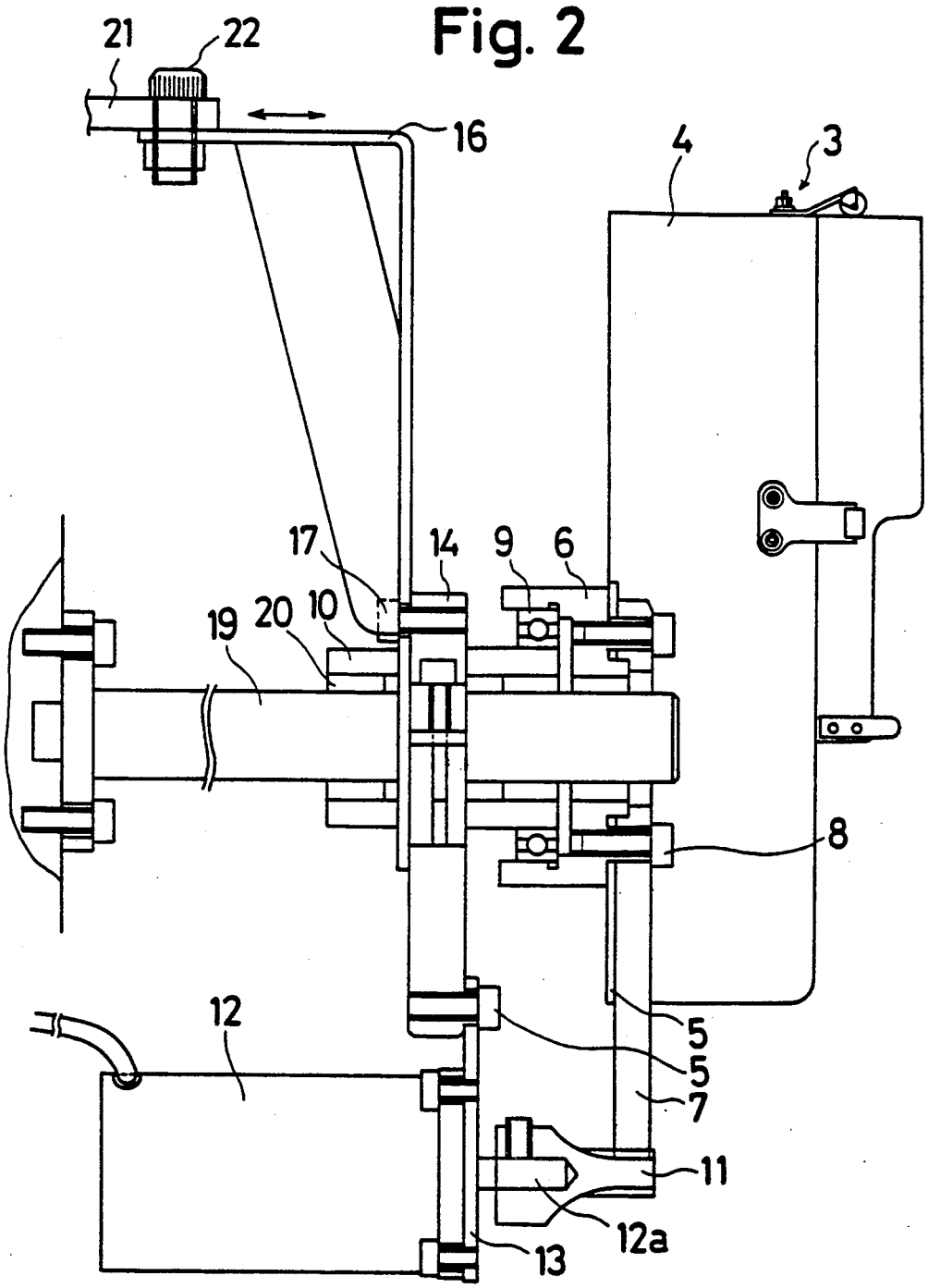
FIG. 2 is a cross-sectional view of a main portion of an embroidering machine.
Figure 3:
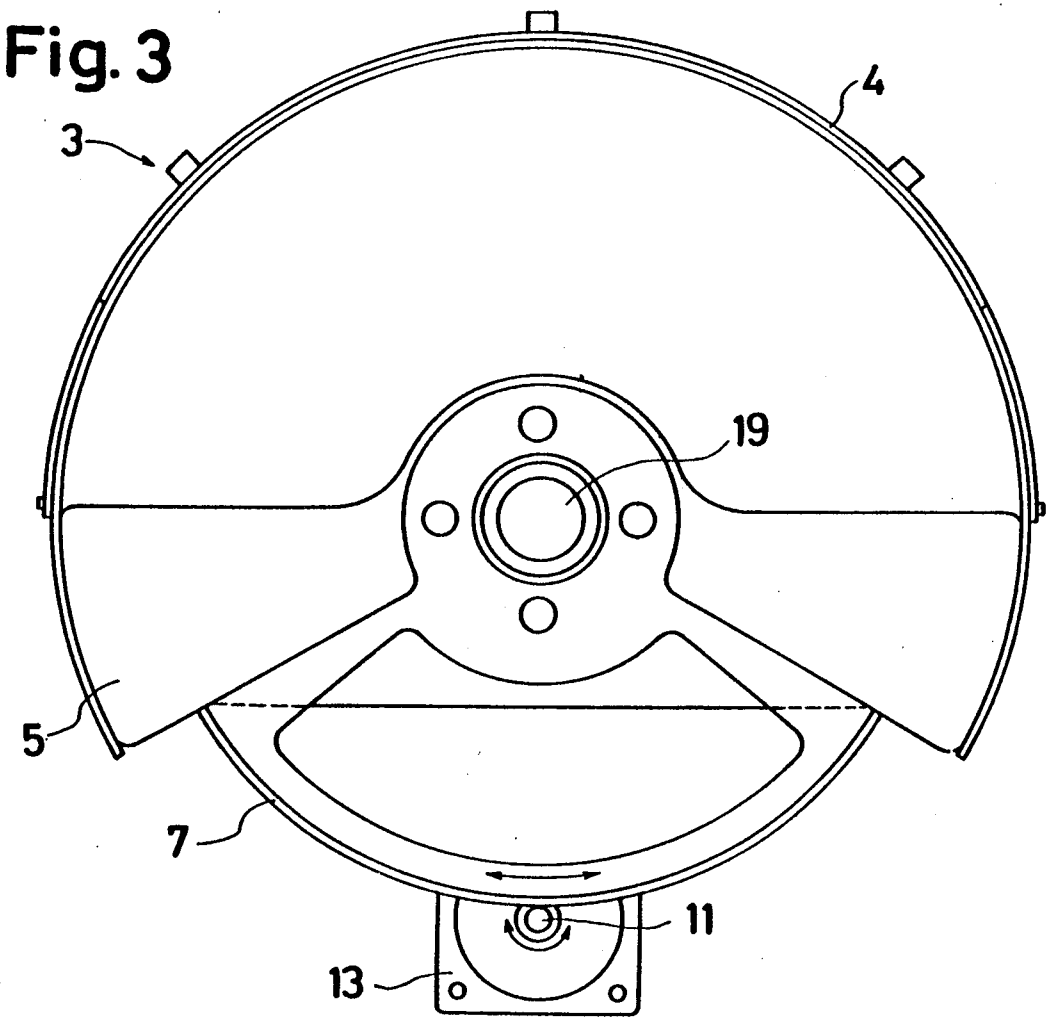
FIG. 3 is a right-side view of FIG. 2.
Figure 4:
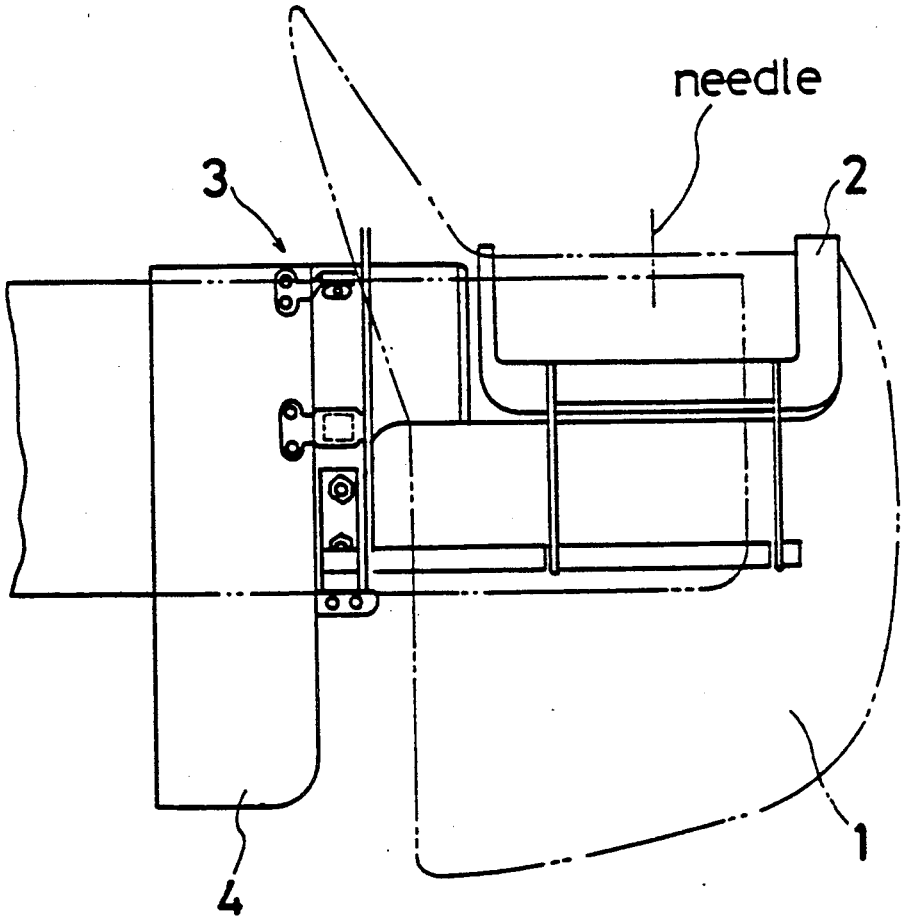
FIG. 4 is a view similar to FIG. 2 but shows a workpiece to be stitched with one or plural embroideries.

Referring now to FIGS. 1 through 4, a workpiece 1 such as a cap or hat, which is under tension, is held on an embroidering frame 2. The embroidering frame 2 is held via a well-known means 3 on a base frame 4. A plate 5 of the base frame 4 is secured with a casing 6 and a supporting gear 7 by common bolts 8. The casing 6 is mounted on a bearing 9 so as to be rotatable relative to a sleeve 10. The supporting gear 7 is in meshing engagement with a motor gear 11 which is secured on a distal end of a shaft 12*a* of a motor 12. The motor 12 is held by a bracket 13 which is secured to a base member 14 by bolts 15. The base member 14 is mounted on the sleeve 10 so as to be rotatable relative thereto and is also secured via bolts 17 to a holder 16.

Figure 5:
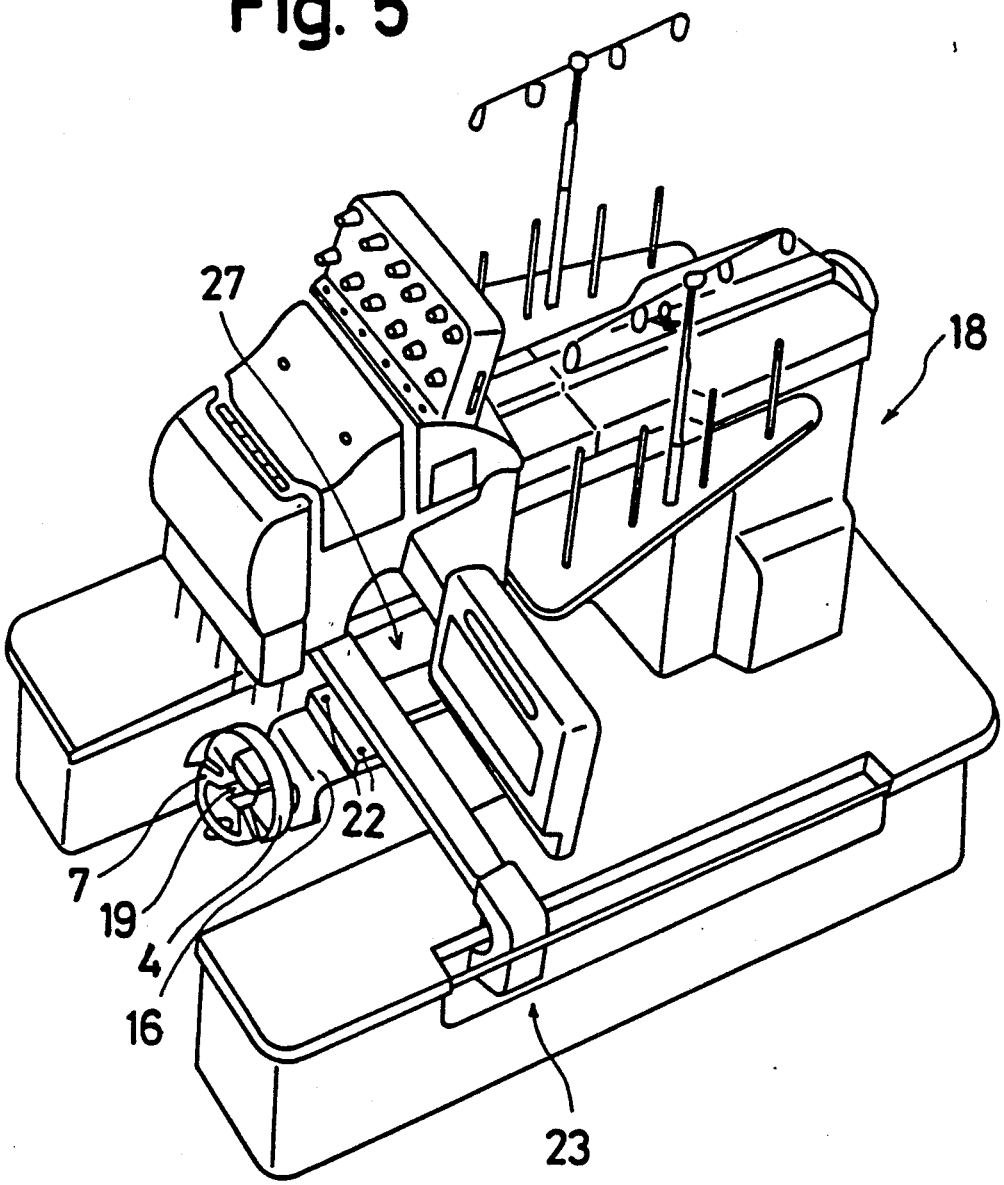
FIG. 5 is a perspective view of an embroidering machine per se.

As shown in FIG. 5, an embroidering machine 18 which is of a well-known structure includes a stationary shaft 19, on which is mounted the foregoing unit via brush 20. The bush 20 is pressed in the sleeve 10 and is slidable on the stationary shaft 19. The holder 16 is connected via a bolt 22 to a holder 21 of a driving mechanism 23, by which the holder 16 and the unit are moved along the stationary shaft 19.

In operation, when the motor 12 is turned on, the resulting rotation is transmitted via the motor gear 11 to the supporting gear 7, thereby establishing the swing movement thereof. Thus, the base frame 4 is brought into similar movement resulting in the circumferential movement of the workpiece 1 which is held by the embroidering frame 2. In addition, due to the actuation of the driving mechanism 23, the base frame 4 is moved in the horizontal direction, thereby moving the workpiece 1 on the embroidering frame 2 in the horizontal direction. By adjusting the quantities of the horizontal and circumferential movements of the embroidering frame 2, one or more embrodieries are stiched on the workpiece 1.

As mentioned above, the motor 12 is secured to the holder 16 so as to be brought into unitary movement with the base frame 4 by which the embroidering frame 2 is held, which reduces the number of parts and results in a simplification of the related mechanism. Furthermore, data of each embroidery can be directly reflected on the control data for the circumferential movement of the shaft 12*a* of the motor 12.

Obviously, numerous modifications and variations of the present invention are possible in light of the above teachings. It is therefore to be understood that within the scope of the appended claims, the invention may be practiced otherwise than as specifically described herein.

What is claimed is:

1. An embroidering machine comprising:

a stationary shaft having a longitudinal axis;

a sleeve slidably mounted on the stationary shaft;

frame means rotatably mounted on the sleeve for holding a cylindrical portion of a workpiece to be stitched, said frame means being mounted for rotation about an axis that is concentric with the longitudinal axis of the shaft;

a holder secured to the sleeve;

a motor for swinging the frame means about an axis that is concentric with the longitudinal axis of the shaft; and driving means for moving the holder along the stationary shaft.

2. An embroidering machine according to claim 1 further comprising a bearing disposed between the stationary shaft and the frame means.

3. An embroidering machine according to claim 1, wherein the frame means includes a base frame, and an embroidering frame detachable form the base frame for holding the cylindrical portion of the workpiece.

4. An embroidering machine according to claim 1, wherein the workpiece is a cap.

5. An embroidering machine according to claim 1, wherein the shaft on which the sleeve is slidably mounted and on which the frame means is rotatably mounted is circular in cross-section.

6. An embroidering machine according to claim 1, including a base member to which the holder is connected and first connecting means for connecting the base member to the motor, said base member being mounted on the sleeve.

7. An embroidering machine according to claim 6, including second connecting means for connecting the holder to the driving means, and wherein said sleeve, said frame means, said holder, said base member and said motor are detachably connected as a unit to said driving means by way of said second connecting means.

* * * * *